US005297405A

United States Patent [19]

Manning et al.

[11] Patent Number: 5,297,405

[45] Date of Patent: Mar. 29, 1994

[54] DOOR HANDLE ASSEMBLY WITH SNAP-IN KEY CYLINDER

[75] Inventors: Steven F. Manning, Northville; Michael E. Compeau, Fraser; James D. Girard, St. Clair Shores; Joseph E. Mishark, Rochester Hills, all of Mich.

[73] Assignee: General Motors Corporation, Detroit, Mich.

[21] Appl. No.: 8,106

[22] Filed: Jan. 25, 1993

[51] Int. Cl.[5] ..... E05B 9/08

[52] U.S. Cl. ..... 70/208; 70/370; 70/416; 70/422; 70/452; 70/466; 292/DIG. 38

[58] Field of Search ..... 70/1.5, 466, 208, 381, 70/416, 422, 370, 452, 449, 451; 292/DIG. 38

[56] References Cited

U.S. PATENT DOCUMENTS

| | | | |
|---|---|---|---|
| 2,103,987 | 12/1937 | Kistner | 70/451 |
| 2,719,423 | 10/1955 | Hammerly | 292/DIG. 38 X |
| 2,724,958 | 11/1955 | Psik | 70/181 |
| 2,795,948 | 6/1957 | Rayburn | 70/451 |
| 3,048,436 | 8/1962 | Schiowitz | 70/451 |
| 3,604,230 | 9/1971 | Tixier | 292/DIG. 38 X |
| 3,733,865 | 5/1973 | Vorob | 70/370 |
| 4,201,069 | 5/1980 | Katayama et al. | 70/422 |
| 4,842,312 | 6/1989 | Iwasaki et al. | 292/336.3 |
| 4,910,982 | 3/1990 | Dana | 70/370 |
| 5,029,917 | 7/1991 | Szerlag et al. | 292/DIG. 38 X |
| 5,040,652 | 8/1991 | Fish et al. | 70/422 X |
| 5,056,344 | 10/1991 | Bartczak | 70/381 |

FOREIGN PATENT DOCUMENTS

| | | | |
|---|---|---|---|
| 799686 | 11/1968 | Canada | 70/208 |
| 289397 | 10/1931 | Italy | 70/381 |
| 332245 | 11/1935 | Italy | 70/208 |
| 443050 | 1/1968 | Switzerland | 70/208 |

*Primary Examiner*—Lloyd A. Gall
*Attorney, Agent, or Firm*—Todd L. Moore

[57] ABSTRACT

A door handle assembly having a snap-in attachment apparatus for assembling a key cylinder to a door handle assembly without the use of separate fasteners and retainers. The door handle assembly has a bored tubular extension that utilizes slots to define tubular sections that yield radially outward upon inserting the key cylinder into the bore of the tubular extension. The tubular sections have openings that receive lugs extending from the periphery of the key cylinder and that prohibit inward axial movement and rotary movement of the key cylinder. A shoulder in the door handle assembly abuts an end of the key cylinder to prohibit outward axial movement of the key cylinder. The engaging surfaces of the lugs and tubular sections have drafted angles that pull the tubular sections radially inward toward the key cylinder upon a push-in force applied to the key cylinder from outside the vehicle and directed toward the center of the vehicle. The tubular extension and key cylinder also have alignment surfaces for orientating a key slot of the key cylinder in a conventional vertical position.

7 Claims, 2 Drawing Sheets

DOOR HANDLE ASSEMBLY WITH SNAP-IN KEY CYLINDER

The present invention relates to a door handle assembly and more particularly a key cylinder that assembles to a plastic shell of a vehicle door handle assembly without the use of separate fasteners and retainers.

BACKGROUND OF THE INVENTION

Generally, all vehicles have an attached door handle assembly comprising of a plastic shell, a key cylinder and a door handle. It is well known to use a threaded stud and nut assembly to attach the key cylinder to the plastic shell, but this requires a plurality of fastening parts as well as assembly time to assemble the fastening parts. It is also known to use a snap-in attachment apparatus in conjunction with conventional fasteners to attach the key cylinder to the plastic shell of the door handle assembly. Such designs are susceptible to having the key cylinder pushed in by forces applied to the key cylinder from outside the vehicle. It would be desirable to provide a snap-in attachment apparatus for connecting a key cylinder to a door handle assembly that reduces the number of parts, as well as assembly time, and that requires a substantial force to push in the key cylinder from outside the vehicle.

SUMMARY OF THE INVENTION

The present invention provides a snap-in attachment apparatus for connecting a key cylinder to a vehicle door handle assembly that minimizes parts and assembly time as well as requiring a substantial force to push in the key cylinder from outside the vehicle. The present invention provides increased security of the vehicle by having the retaining forces that retain the key cylinder in the door handle assembly correspondingly increase with a push-in force applied to the key cylinder. An additional feature requires the key cylinder to be orientated in a particular position for assembly such that a key slot of the key cylinder is maintained in a conventional vertical position.

In the preferred form, the present invention comprises a plastic shell for housing a door handle and a key cylinder. The plastic shell has a tubular extension extending inward from the rear side of the shell towards the center of the vehicle. The tubular extension has a bored cylindrical configuration with slots that define tubular sections. The bore of the tubular extension receives the key cylinder, and the tubular sections yield radially outward from their normal free-state position upon the key cylinder being inserted into the bore of the tubular extension. The plastic shell has an aperture that is smaller than and shares a center-line axis with the bore of the tubular extension. The difference in diameters creates a shoulder that abuts the key cylinder and prohibits the key cylinder from outward axial movement away from the vehicle.

Each tubular section has an opening by which to receive corresponding lugs located on the periphery of the key cylinder. Upon the openings receiving the lugs, the tubular sections move from their outward radial yielding position to their natural free-state position. The top side of the lugs engage shoulders that are formed by a portion of the tubular sections that define the openings in the tubular sections and that prohibit the key cylinder from inward axial movement toward the center of the vehicle. The sides of the lugs engage side walls of the tubular sections that define the openings and prohibit rotary movement of the key cylinder. The top side of the lugs and the shoulders of the tubular sections have corresponding angles, so that upon a push-in force applied to the key cylinder from outside the vehicle and directed toward the center of the vehicle, the tubular sections are pulled radially inward, toward the key cylinder, thereby creating a greater retention force on the key cylinder than if the tubular sections were pushed straight inward.

One of the tubular sections has a recessed channel on the inner wall of the tubular section, and the channel extends from the free end of the tubular section to beyond its opening. The key cylinder has a lug that is larger than the other lugs and which snugly slides within the channel. The key cylinder can only be assembled to the tubular extension when the larger lug is engaging the channel. The larger lug and channel correspond in circumferential alignment to the key slot in the key cylinder, so the key slot is in a conventional vertical position upon the larger lug engaging the channel.

Thus, the objects of the present invention are to provide a new and improved vehicle door handle assembly that provides a snap-in attachment apparatus for connecting the key cylinder to the door handle assembly and minimizes or eliminates separate fasteners while also reducing assembly time; to provide a new and improved door handle assembly that requires a substantial force to push in the key cylinder from outside the vehicle; and to provide a new and improved door handle assembly that orientates the key slot of the key cylinder so that the key slot is in a conventional vertical position.

DESCRIPTION OF THE PREFERRED EMBODIMENTS

Figure 1:
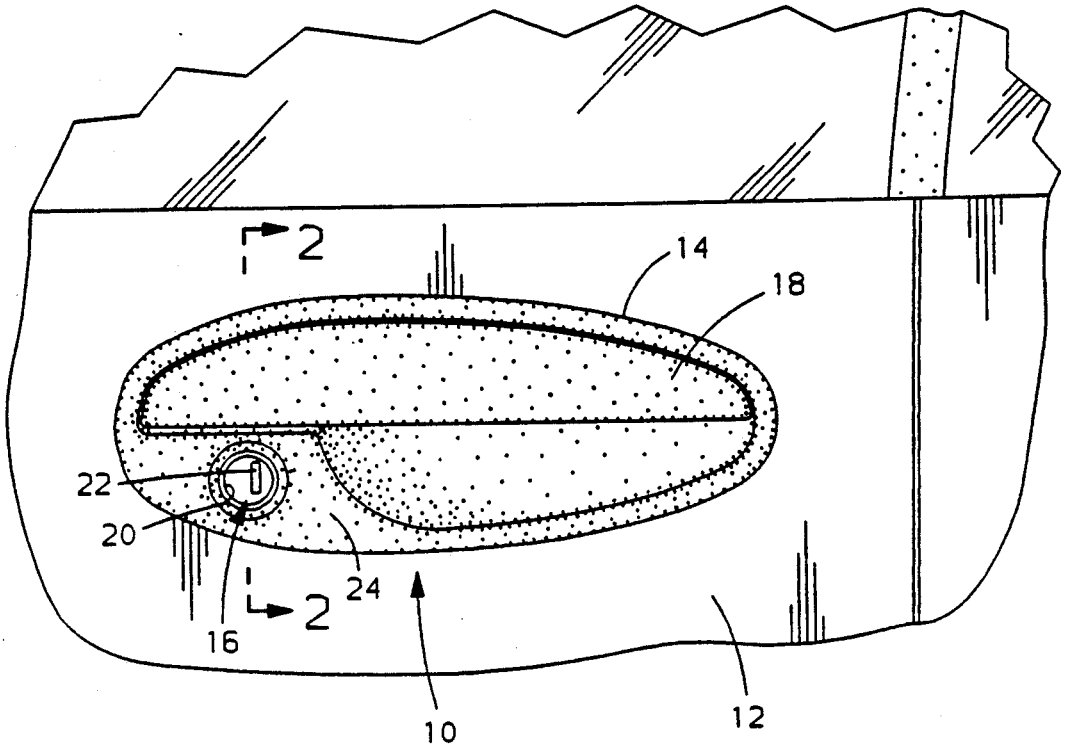
FIG. 1 is a side elevation view showing the door handle assembly as typically mounted to a vehicle door.

Referring to the drawings, the present invention will now be described in detail with reference to the preferred embodiment.

FIG. 1 shows the present invention being utilized in a door handle assembly (10) of a vehicle passenger door (12). The door handle assembly (10) has a plastic shell (14) that houses a key cylinder (16) and a conventional door handle (18). The plastic shell (14) has an aperture (20) for access to a key slot (22) in the key cylinder (16).

Figure 2:
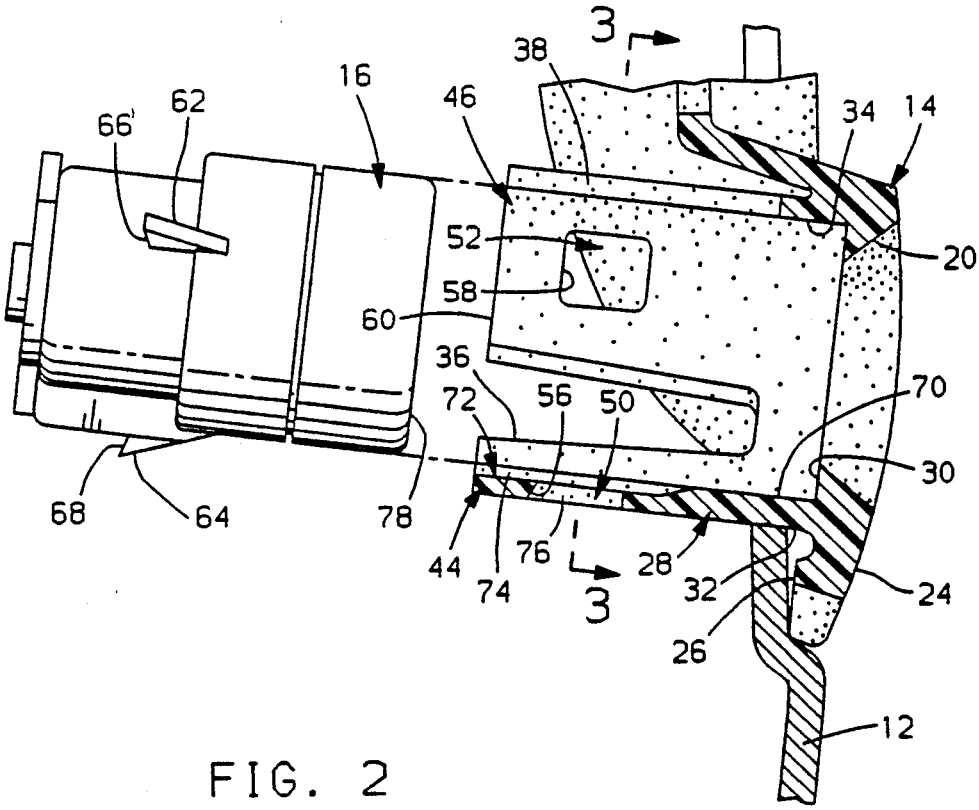
FIG. 2 is a section view taken in the direction of arrows 2—2 of FIG. 1 showing the tubular sections and openings therethrough with an exploded view of the key cylinder and the tubular extension.

The plastic shell (14) of the door handle assembly (10) has an outside surface (24) that is exposed to the outside of the vehicle and an inside surface (26) that faces the center of the vehicle. As seen in FIG. 2, the plastic shell (14) has a tubular extension (28) that is integral with and extends from the inside surface (26) of the plastic shell

Figure 3:
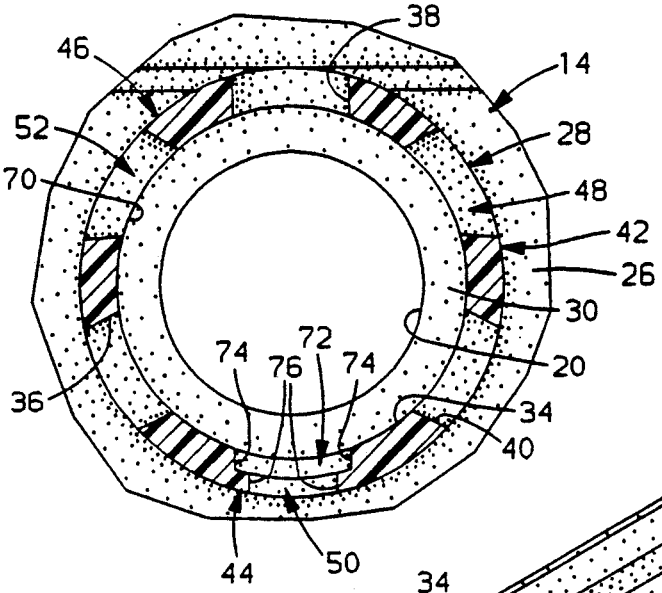
FIG. 3 is a section view taken in the direction of arrows 3—3 of FIG. 2 showing the tubular sections and the openings.
Figure 5:
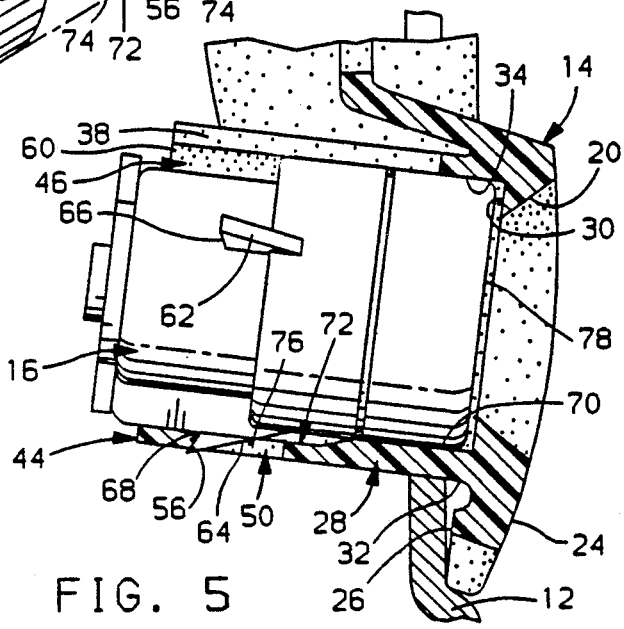
FIG. 5 is a section view similar to FIG. 2 showing the acute angles of the engaging surfaces of the lugs of the key cylinder and of the shoulders of the tubular sections in the assembled position.

(14) toward the center of the vehicle. The aperture (20) in the plastic shell (14) extends from the outside surface (24) of the plastic shell (14) into the interior portion of the tubular extension (28). As seen in FIG. 3, the aperture (20) is smaller in diameter than the inside diameter of the tubular extension (28), and this difference in diameters creates a shoulder (30) in the integral end (32) of the tubular extension (28). When assembled, the key cylinder (16) abuts the shoulder (30) thereby prohibiting the key cylinder (16) from outward axial movement away from the vehicle, as seen in FIG. 5.

Figure 4:
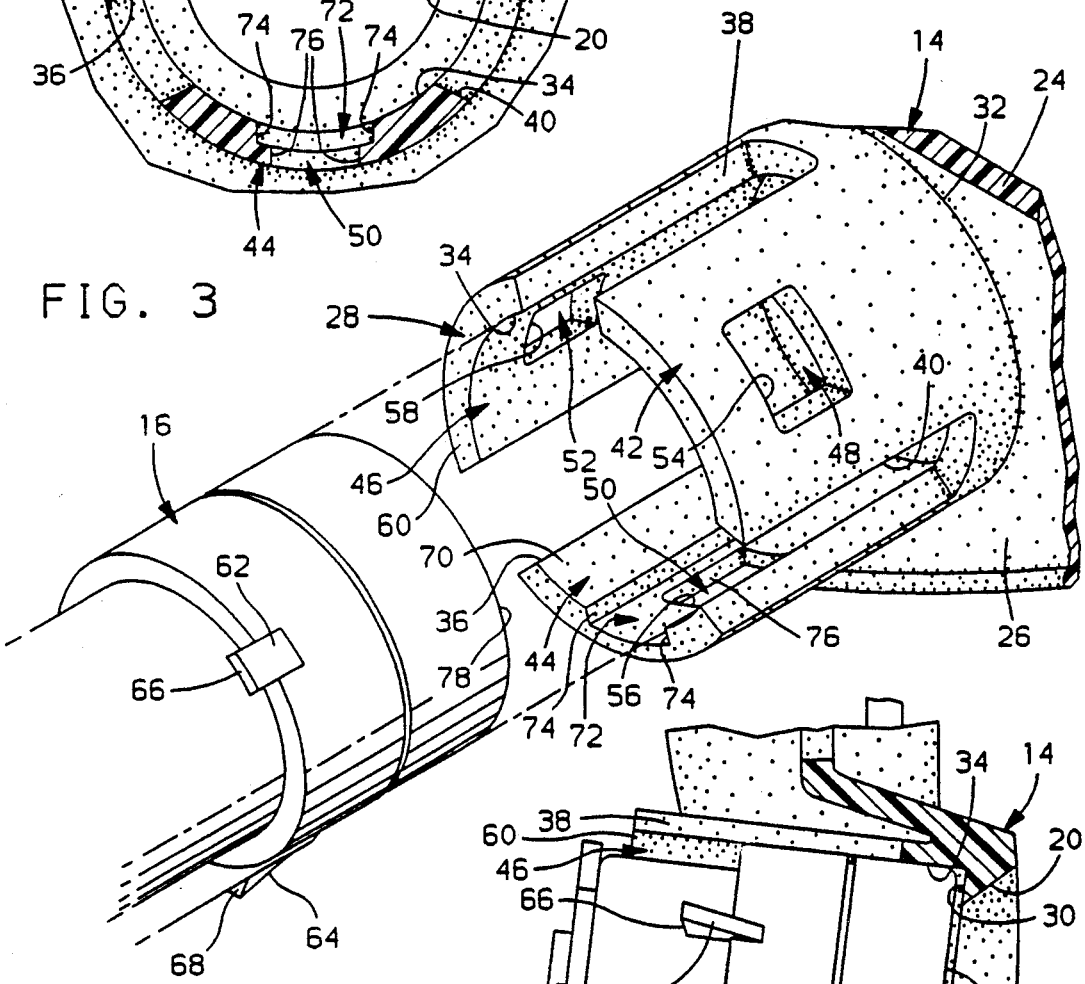
FIG. 4 is a perspective view of the tubular section of the tubular extension with an exploded view of the key cylinder and the tubular extension.

The tubular extension (28) is fabricated from plastic and has a substantially cylindrical configuration with a bore (34) extending therethrough, as seen in FIG. 4. The tubular extension (28) has three equally spaced slots (36),(38),(40) extending therethrough and defining three tubular sections (42),(44),(46). It should be noted that the present invention is not limited to three tubular sections but rather may have any number of tubular sections. The tubular sections (42),(44),(46) yield radially outward upon inserting the key cylinder (16) into the tubular extension (28), as discussed hereinafter.

Each tubular section (42),(44),(46) has a substantially rectangular opening (48),(50),(52), respectively, extending therethrough, as seen in FIGS. 2–4. Each opening (48),(50),(52) has a shoulder (54),(56),(58), respectively, that is defined by one of four sides in the tubular sections (42),(44),(46) that define the openings (48),(50),(52). The shoulders (54),(56),(58) are the sides closest to the free end (60) of the tubular sections (42),(44),(46).

The key cylinder (16) has three lugs (62),(64), (only two shown) extending radially outward from the periphery of the key cylinder (16). The three lugs (62),(64) are in corresponding circumferential alignment with the three openings (48),(50),(52) in the tubular sections (42),(44),(46). Each lug (62),(64) has a top surface (66),(68) that engages the shoulders (54),(56),(58) of the tubular sections (42),(44),(46) and prohibits the key cylinder (16) from inward axial movement toward the center of the vehicle.

As seen in FIG. 5, the top surface (66),(68) of the lugs (62),(64) are at acute angles relative to the periphery of the key cylinder (16). The shoulder (54),(56),(58) of the tubular sections (42),(44),(46) are also at acute angles relative to an inside wall (70) of the tubular sections (42),(44),(46). When a push-in force is applied to the key cylinder (16) from outside the vehicle and directed toward the center of the vehicle, the corresponding angles of the top surfaces (66),(68) of the lugs (62),(64) and the shoulders (54),(56),(58) of the tubular sections (42),(44),(46) pull the tubular sections (42),(44),(46) radially inward toward the key cylinder (16). The retention force applied to the key cylinder (16) by the tubular sections (42),(44),(46) correspondingly increases with the push-in force applied to the key cylinder (16). This increases the security of the vehicle as it becomes increasingly more difficult to push in the key cylinder (16) from outside the vehicle.

The present invention provides for a proper orientation of the key cylinder (16) so that the key slot (22) is assembled in a conventional vertical position. As seen in FIG. 4, one of the tubular sections (44) has a recessed channel (72) extending along the inside wall (70) of the tubular section (44). The channel (72) extends from the free end (60) of the tubular section (44) to beyond the opening (50) in the tubular section (44). The largest (64) of the three lugs (62),(64) of the key cylinder (16) corresponds in circumferential alignment with the channel (72) in the tubular section (44), so the key slot (22) of the key cylinder (16) is in a conventional vertical position when the largest lug is engaging the channel (72). The largest lug (64) of the key cylinder (16) is designed to snugly slide within the channel (72) of the tubular section (44) until the top surface (66),(68) of the three lugs (62),(64) engage the shoulders (54),(56),(58) of the openings (48),(50),(52) in the tubular sections (42),(46),(48). The key cylinder (16) can only be assembled to the tubular extension (28) if the largest lug (64) is engaging the channel (72).

The channel (72) has opposing sides (74), and the corresponding opening (50) for the largest lug (64) has opposing sides (76) substantially perpendicular to the corresponding shoulder (56) and helping to define the opening (50). The sides of the largest lug (64) engage the channel sides (74) and the sides (76) of the opening (50) to prohibit rotary movement of the key cylinder (16) relative to the tubular extension (28).

Upon assembling the key cylinder (16) into the plastic shell (14) of the door handle assembly (10), the key cylinder (16) is inserted into the tubular extension (28) either before or after assembly of the plastic shell (14) to the vehicle door (12). Upon aligning the key cylinder (16) to the bore (34) of the tubular extension (28), the largest lug (64) is aligned with the channel (72), and the key cylinder (16) is inserted into the bore (34) of the tubular extension (28) toward the shoulder (30) in the integral end (32) of the tubular extension (28). The largest lug (64) engages the channel (72) and acts as a locator for the other two smaller lugs (62) of the key cylinder (16). As the key cylinder (16) is pushed into the bore (34) of the tubular extension (28), the tubular sections (42),(44),(46) yield outward allowing the key cylinder (16) to slide into the bore (34) of the tubular extension (28). The lugs (62),(64) of the key cylinder (16) engage the shoulders (54),(56),(58) of the openings (48),(50),(52) of the tubular sections (42),(44),(46) thereby prohibiting inward axial movement of the key cylinder (16) relative to the tubular extension (28). An end (78) of the key cylinder (16) abuts the shoulder (30) at the integral end (32) of the tubular extension (28) to prohibit outward axial movement of the key cylinder (16) away from the vehicle. The sides of the largest lug (64) engage the sides of the channel (72) and the sides of the corresponding opening (50) to prohibit rotary movement of the key cylinder (16) relative to the tubular extension (28).

Thus, it is seen that the present invention provides a new and improved door handle assembly (10) that connects the key cylinder (16) to the door handle assembly (10) without the need for separate conventional fasteners and that requires a substantial push-in force to remove the key cylinder (16) from outside the vehicle.

The embodiments of the invention in which an exclusive property or privilege is claimed are defined as follows:

1. A vehicle door handle assembly in a vehicle having an apertured shell and a key cylinder having a key slot comprising:

a tubular extension integral with and extending inwardly from said shell and having a free end and said tubular extension defining a bore that receives said key cylinder;

said tubular extension having a plurality of slots defining a plurality of tubular sections radially yieldable outwardly from their natural free state positions;

at least one of said plurality of tubular sections having an opening extending therethrough and having a shoulder;

at least one lug extending radially outward from the periphery of said key cylinder and engaging said shoulder of said tubular section thereby prohibiting movement of said key cylinder; and means for positioning said key cylinder so that said key slot is orientated in a desired position.

2. A vehicle door handle assembly as stated in claim 1 wherein said means for positioning said key cylinder comprises:

said plurality of tubular sections having an inside wall;

said tubular section with said opening having a substantially rectangular channel on said inside wall of said tubular section and said channel extending from said free end of said one tubular section to beyond said opening in said one tubular section;

said at least one lug being designed to snugly slide within said channel; and said at least one lug being in circumferential alignment with said key cylinder and said channel so that said key slot is in a desired position.

3. A vehicle door handle assembly as stated in claim 1 comprising:

a top surface of said at least one lug extending outward at an acute angle from said key cylinder and engaging said shoulder of said at least one tubular section; and said shoulder being at said acute angle from an inside wall of said at least one tubular section whereby said at least one tubular section is pulled radially inward toward said key cylinder upon a force applied to said key cylinder from outside said vehicle and directed toward the center of said vehicle.

4. A vehicle door handle assembly having an apertured plastic shell and a key cylinder having a key slot comprising:

a plastic tubular extension integral with and extending inwardly from said plastic shell and having a free end and said plastic tubular extension defining a bore that receives said key cylinder;

said plastic tubular extension having three slots spaced at equal circumferential distances defining three tubular sections radially yieldable outwardly from their natural free state positions;

said tubular sections each having an opening extending therethrough and having a shoulder;

three lugs extending radially outward and being spaced at substantially equal circumferential distances along the periphery of said key cylinder and engaging said shoulders of said tubular sections to prohibit movement of said key cylinder; and means for positioning said key cylinder so that said key slot is in a desired orientation.

5. A vehicle door handle assembly as stated in claim 4 wherein said means for positioning said key cylinder comprises:

said plurality of tubular sections having an inside wall;

one of said three tubular sections having a substantially rectangular channel on said inside wall of said tubular section and said channel extending from said free end of said one tubular section to beyond said opening in said one tubular section;

one of said three lugs being larger than said other lugs and snugly sliding within said channel; and said one lug being in circumferential alignment with said key cylinder and said channel so that said key slot is in a desired position.

6. A vehicle door handle assembly as stated in claim 4 comprising:

a top surface of said three lugs extending outward at an acute angle from said key cylinder and engaging said shoulders of said tubular sections; and said shoulders being at said acute angles from an inside wall of said tubular sections whereby said tubular sections are pulled radially inward toward said key cylinder upon a force applied to said key cylinder from outside said vehicle and directed toward the center of said vehicle.

7. A vehicle door handle assembly having an apertured plastic shell and a key cylinder having a key slot comprising:

said apertured plastic shell connected to said vehicle and having an outside surface facing away from said vehicle and an inside surface facing toward the center of said vehicle;

a plastic tubular extension integral with said inside surface of said plastic shell and extending toward the center of said vehicle and having a free end and defining a bore that receives said key cylinder;

said plastic tubular extension having three slots spaced at substantially equal circumferential distances defining three tubular sections radially yieldable outwardly from their natural free state positions;

said three tubular sections each having an inside wall and a substantially square opening extending therethrough and defined by four sides of said tubular sections;

a shoulder formed by one of said four sides of said tubular sections that is closest to said free end of said tubular extension and said shoulders being at acute angles from said inside wall of said tubular sections;

one of said three tubular sections having a substantially rectangular channel on said inside wall of said tubular section and said channel extending from said free end of said one tubular section to beyond said opening in said tubular section;

three lugs extending radially outward and being spaced at substantially equal circumferential distances along the periphery of said key cylinder and each of said three lugs having a top surface extending outward at an acute angle from said key cylinder;

one of said three lugs being larger than the others and snugly sliding within said channel and being in circumferential alignment with said key cylinder and said channel so that said key slot is in a conventional vertical position; and said top surfaces of said three lugs engaging said shoulders of said tubular sections to prohibit movement of said key cylinder relative to said tubular extension and having said acute angles of said top surface of said three lugs and said shoulder of said tubular sections pull said tubular sections radially inward toward said key cylinder upon a pushing force applied to said key cylinder from outside said vehicle and directed toward the center of said vehicle.

* * * * *